US008549980B2

(12) United States Patent
Iardella

(10) Patent No.: US 8,549,980 B2
(45) Date of Patent: Oct. 8, 2013

(54) HANDLING SYSTEM FOR A WEAPON PLACED ON A TURRET

(75) Inventor: Carlo Alberto Iardella, Carrara (IT)

(73) Assignee: OTO Melara S.p.A., La Spezia (IT)

( * ) Notice: Subject to any disclaimer, the term of this patent is extended or adjusted under 35 U.S.C. 154(b) by 0 days.

(21) Appl. No.: 13/515,224

(22) PCT Filed: Dec. 3, 2010

(86) PCT No.: PCT/IB2010/003188

§ 371 (c)(1),
(2), (4) Date: Nov. 6, 2012

(87) PCT Pub. No.: WO2011/070435

PCT Pub. Date: Jun. 16, 2011

(65) Prior Publication Data

US 2013/0042749 A1 Feb. 21, 2013

(30) Foreign Application Priority Data

Dec. 11, 2009 (IT) ..... TO2009A0976

(51) Int. Cl.
*F41A 27/00* (2006.01)

(52) U.S. Cl.
USPC ..... 89/41.02; 89/37.03; 89/40.03

(58) Field of Classification Search
USPC ..... 89/41.02, 41.17, 37.03, 37.12, 40.03
See application file for complete search history.

(56) References Cited

U.S. PATENT DOCUMENTS

| | | | | |
|---|---|---|---|---|
| 7,030,579 | B1 | 4/2006 | Schmitz et al. | |
| 2005/0257680 | A1 | 11/2005 | Russell | |
| 2011/0023698 | A1 * | 2/2011 | Hayden et al. | 89/41.02 |
| 2012/0186440 | A1 * | 7/2012 | McKee et al. | 89/41.02 |

FOREIGN PATENT DOCUMENTS

| | | |
|---|---|---|
| EP | 1 333 240 | 8/2003 |
| EP | 1 992 900 | 11/2008 |

OTHER PUBLICATIONS

International Search Report for International Application No. PCT/IB2010/003188 mailed Mar. 28, 2011.

* cited by examiner

*Primary Examiner* — J. Woodow Eldred
(74) *Attorney, Agent, or Firm* — Merchant & Gould P.C.

(57) ABSTRACT

A handling system is for a weapon (2) placed on a turret. The weapon is provided with a barrel (21) from which the bullets are shot and with a handle (22) through which the operator determines the traverse of the weapon. The weapon is mounted on a circumferential fifth wheel including a fixed portion (31) integral with the turret and a movable portion (32) on which the weapon is mounted, in order that the movable fifth wheel rotates on the fixed one, permitting the movement of the weapon along the circumference (C).

10 Claims, 1 Drawing Sheet

HANDLING SYSTEM FOR A WEAPON PLACED ON A TURRET

This application is a National Stage Application of PCT/IB2010/003188, filed 3 Dec. 2010, which claims benefit of Serial No. TO2009A000976, filed 11 Dec. 2009 in Italy and which applications are incorporated herein by reference. To the extent appropriate, a claim of priority is made to each of the above disclosed applications.

BACKGROUND

The present invention relates to a handling system for a weapon, for example mounted on the turret of a tracked or wheeled military-type vehicle.

The terrestrial weapon small-caliber systems are very often installed on the roof of light vehicles and are handled by an operator, who protrudes with the upper portion of his body from the vehicle itself, through a circular manhole and manually traverse the aforementioned weapon, which is hinged on a suitable support (mount) for a necessarily limited angle. In order to increase the angle covered by the firing line of the weapon, the mount of the weapon is normally placed on a rotary circular ring, normally called fifth wheel, with which often the manhole with its cover is integral, and often also enveloping ballistic peripheral protections. It is apparent that the operator ("man in fifth wheel") is surely the most exposed man to the possibility of being hit by the enemy fire and, for such reason, the protection reduces in a certain way the exposition of the operator, protecting him as much as possible in accordance with the need to observe, aim and shoot.

So the rotation of the fifth wheel permits to the operator to cover with the firing line of the weapon, traverse with respect to the fifth wheel itself, even up to 360°. This can occur manually or, in particular in the case of protections, in a motorized way with the introduction of an electric or hydraulic motor in order to assist or permit his task to the operator.

A system of such type is described in U.S. Pat. No. 7,030,579, which discloses a system and a method for motorizing the rotation of a turret, on which a weapon is placed, in which the manhole has a circular rack on the circumference and the turret has a motorized pinion engaging with the rack itself by permitting the rotation of the turret. The movement of the turret is controlled by a separate control device realized by a joystick.

The Applicant has observed that, in such a system for rotating the fifth wheel, the operator must act on a manual control (joystick or button panel), so committing one hand which must necessarily release the weapon, so making the system less practical and, in any case, not ready to respond to a sudden threat.

SUMMARY

Aim of the present invention is to overcome the aforementioned drawbacks by realizing a handling system of a turret, and particularly of a fifth wheel, on which a manually traversable weapon from an operator is placed, which permits the operator to rotate within 360° the fifth wheel without committing his hands, which can be exclusively used for the control and the driving of the weapon itself.

A feature of the present invention relates to a handling system for a weapon placed on a turret.

BRIEF DESCRIPTION OF THE DRAWINGS

Characteristics and advantages of the system are given according to an exemplary and non limitative embodiment of the invention with reference to the annexed figures in which.

DETAILED DESCRIPTION

Figure 1:
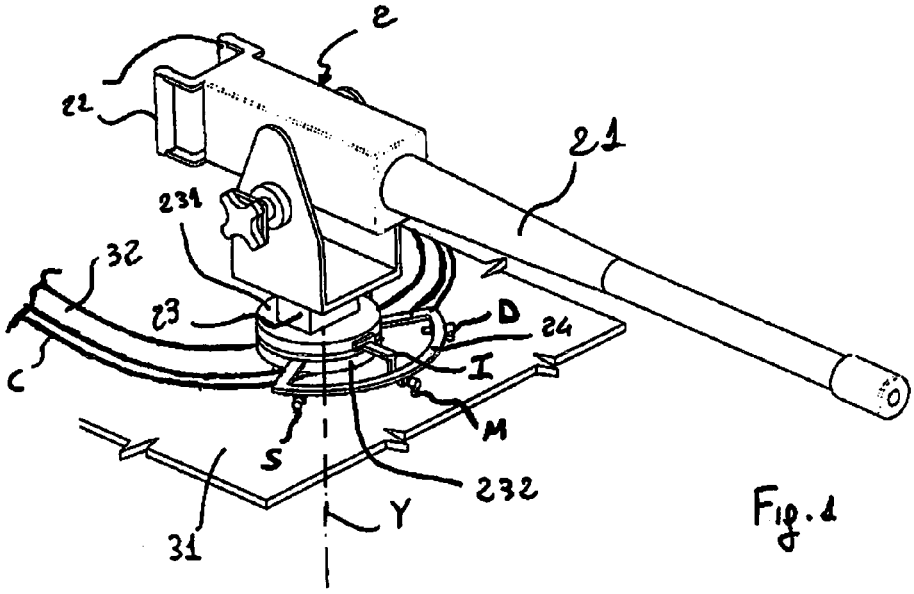
FIG. 1 represents a perspective view of the weapon placed on a turret according to the present invention.

In FIG. 1 a weapon 2 is shown, provided frontally with a barrel from which the bullets are shot and at its back with a handle 22, through which the operator determines the traverse of the weapon itself around a vertical axis Y, passing through the centre of a base of weapon 23, provided with a rotary bearing.

The weapon is mounted on a circumferential fifth wheel 3 comprising a fixed portion 31 integral with the roof of the vehicle. and a movable portion 32, on which the weapon itself is mounted. So, the movable fifth wheel rotates on the fixed one so permitting to the mounted weapon to rotate along circumference C of the fifth wheel, for a number of turns even greater than one and also just for fractions of 360°.

The system according to the present invention comprises handling means for the rotation of such fifth wheel, for example comprising an electric motor, a sensor assembly placed near the base of the weapon, for example near the rotary bearing and able to recognize the rotations around axis Y, manually imposed from the operator to the weapon, to the right and to the left, and to indicate when the rotation reaches a predetermined right or left limit traverse angle, with respect to a central predetermined position.

The system also comprises a control unit adapted to detect the information from such sensors and actuate the rotation of the fifth wheel, through such handling means, when the rotations of the weapon around axis Y reach such predetermined (left and right) angles.

Clearly, to a clockwise rotation of the weapon around axis Y, which exceeds the predetermined right traverse angle, corresponds a clockwise rotation of the fifth wheel and to a counterclockwise rotation of the weapon around axis Y, which exceeds the predetermined left traverse angle, corresponds a counterclockwise rotation of the fifth wheel.

Due to the rotation of the fifth wheel, imposed when a determined traverse angle is exceeded, it is obtained that the firing axis of the weapon itself return practically centered with respect to the natural traverse arc of the mount integral with the fifth wheel.

The peculiarity of the invention is its automation of the rotation control, which facilitates the maintaining of the optimum traverse field B towards lateral targets, without removing the operator from his main task, that is to promptly and efficiently respond to the threats. Such a proposed system can also be installed on vehicles with a still operating fifth wheel, as it does not require any important modification to the weapon itself, on which just one sensor system must be inserted, and in certain cases, the motorization. In the case of still motorized fifth wheel, the intervention is even more modest, the direct manual control having to be substituted with an electronic unit which, by the aid of the aforementioned sensors, transforms the manual control in an automatic one.

The sensors can be simple mechano-electrical switches actuated in certain positions of the traverse of the mount of the weapon or detected from proximity sensors in various technologies or by an encoder measuring the rotation around axis Y (traverse).

The connection with the control unit can occur through a cable, if the rotation of the fifth wheel is made with a limited angle or number of turns, or when the number of the turns has no limit, through a slip ring; in this latter case it is possible to eliminate the physical connection, by providing the sensor unit of a supply source of its own (e.g. battery) and communicating at a radio frequency with the control unit or through optical signals, with emitters in the movable portion and with receivers placed in suitable positions and, with the needed quantity, in the fixed portion. The optical connection, like the radio one, can be of a two-way (two-direction) type.

A further feature of the present invention is the optional presence of an extra effort mechanism, with which the operator for being able to traverse the weapon near the predetermined traverse limit angle, so actuating the fifth wheel, must make an effort greater that the normal traverse one.

Alternatively, the control unit or the sensor assembly can request a permanence in the limit angle of a predetermined but not instantaneous time, in order to verify the will of the operator to rotate the fifth wheel in order to move the axis of its traverse field of the weapon, before determining the rotation of the fifth wheel.

Preferably, the sensor assembly is positioned near the base of the weapon and particularly the assembly comprises at least a selector I, placed on movable portion 231 of the base of the weapon, moving with the weapon and the movement of which is integral with the traverse one of the shaft of the weapon itself, at least a right limit switch D and at least a left limit switch S, placed on fixed portion 232 of said base, which identify such right and left limit angle. Advantageously, the sensor assembly also comprises an intermediate identifier M of the total traverse angle.

When during the traverse of the weapon selector I aligns itself with the limit switches or with the intermediate identifier, an identifiable signal is transmitted to the control unit.

Selector I, limit switches S and D and intermediate identifier M (optional) can be realized through infrared, opto-electronic or mechanical technologies. For example, proximity sensors or infrared sensors (series of emitting and receiving LEDs) or of other type (inductive electromagnetic or variable reluctance devices, Hall-effect devices, infrared devices, contact devices, etc.)may be used.

Such information of the sensors allows the control unit to manage the operation of the electric motor controlling the fifth wheel; in particular, the motor will be actuated in order to rotate the fifth wheel rightwards, if the operator will point the weapon until reaching the limit switch associated with such movement, leftwards if the operator points the weapon until reaching the relative limit switch, whereas it will stop when the weapon will be returned to the centre, if the intermediate identifier will be used, or in a different position in consequence of a movement of temporized duration.

Due to the need of having a better control of the system (more fluid and performing movements), the number of sensors can be increased (or an encoder can be inserted), in order to identify more positions of the weapon with respect to the permitted rotation sector: with such information the movement of the fifth wheel can be managed in a better way.

According to the present invention the system further comprises on the fifth wheel means for determining the angular rotation of movable portion 32 with respect to fixed one 31, in order to rotate the fifth wheel according to one or more predetermined angles, in response to the actuation of limit switches S or D.

Figure 2:
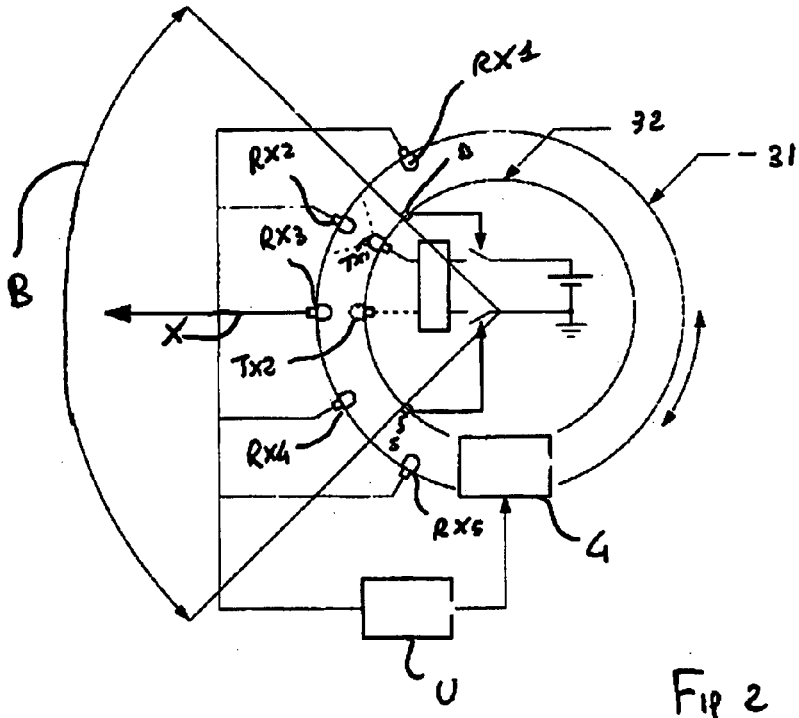
FIG. 2 represents a schematic view of a possible management and control system of the handling for a weapon placed on a turret according to the present invention.

FIG. 2 shows an embodiment of the invention in which the communication between the fixed and the movable portion of the fifth wheel is realized with an opto-electronic transmission and reception.

Such transmission means for determining the angular rotation comprise two rings, one of which is integral with the fixed portion and the other with the movable one: on the ring in the fixed portion a series of receiving photo-diodes RX1 . . . RXn are disposed at a certain mutual distance, which are distributed along the entire circumference and connected with control unit U; on the ring in the movable portion two transmitting diodes TX1 and TX2 are instead positioned, which are actuated by limit switches S and D previously described, and are supplied for example from an auxiliary battery.

By rotating the weapon, the operator when reaching the physical rotation limit, actuates the (right or left) limit switch which in turn feeds one of its transmitting diodes; this enables the conduction of the receiver placed in front of the transmitter which, when detected by the control unit, establishes and begins the sequence of automatic rotation of the fifth wheel. The rotation angle is such to allow the transmitters to find always themselves, at the end of the movement, in front of some of the receiving devices, so beginning a new rotation depending on the actuation of the limit switches. The number of the receivers depends on the rotation angle permitted by the weapon on its own axis and by the transmission and reception lobes of the used devices. In order to simplify the control of the handling of the fifth wheel, it is useful to establish the correct compromise between the number of receivers and amplitude of the lobes.

In order to discriminate the desire of the operator to rotate rightwards or leftwards, two transmitters (impulse codification) with a different frequency can be used, or simply by using a binary logic with equal transmitters: for example one LED lit rightwards, two LEDs lit leftwards; in any case, it is useful to double the circuit in order to avoid, in the case of a damaged LED, a lack of rotation, or a rotation in the opposite direction.

According to an alternative embodiment of the present invention, such transmitting means for determining the angular rotation can comprise a wireless data transmission connection of the movable portion with the fixed one, in this way facilitating the operations for installing the system.

In order to obtain the best performance, in an absolute way the whole sensor assembly can be substituted with sensors of greater precision, like potentiometers, encoders or resolvers, which by giving the continuous position value can permit an ideal control of the system, for example varying the position of limit switches S and D through a software. By implementing such types of sensors, a greater intervention is normally necessary on the rotation system of the weapon, as the installation must take place on the rotation axis or with a connection through gears or belts, whereas in the preceding cases the sensorial subsystem is simply "added" and requires only two connections with the previously existing rotation system (one on the "towards vehicle" portion, the other on the "towards weapon" portion).

The invention claimed is:

1. Handling system for a weapon placed on a turret, said weapon being frontally provided with a barrel from which bullets are shot and at a rear being provided with a handle through which an operator determines traverse of the weapon around a vertical axis passing through a center of a base of the weapon, said weapon being mounted on a circumferential fifth wheel comprising a fixed portion integral with the turret and a movable portion upon which the weapon itself is mounted, in order that the movable fifth wheel rotates on the fixed portion, permitting movement of the weapon along the circumference of the fifth wheel comprising:

handling means for rotation of the fifth wheel, a sensor assembly adapted to recognize the traverses around the axis imposed by the operator to the weapon, towards the right in a clockwise direction or towards the left in a counterclockwise direction, and to indicate when the traverse, reaches a predefined right or left limit angle, and a control unit adapted to detect information from the sensors and actuate rotation of the fifth wheel, in the same direction of traverse of the weapon through the handling means, when the traverse of the, weapon around the axis reach the predefined limit angles.

2. The system according to claim 1, wherein a clockwise direction of the weapon around the axis exceeding a predetermined right traverse angle corresponds a clockwise rotation of the fifth wheel, and to a counterclockwise rotation of the weapon around the axis exceeding a predetermined left traverse angle, corresponds a counterclockwise rotation of the fifth wheel, the amplitude of rotation being determined with a timing of movement or with measurement of angular displacement.

3. The system according to claim 1, wherein the sensor assembly sensors can be mechano-electrical switches actuated in certain positions of the traverse of the weapon mount, detected from proximity sensors.

4. The system according to claim 1, comprising an extra effort mechanism, with which the operator in order to get the traverse of the weapon near the predetermined limit traverse angle, so actuating the fifth wheel, must make a greater effort than a normal traverse.

5. The system according to claim 1, wherein the sensor assembly is positioned near the base of the weapon and comprises at least a selector placed on the movable portion of the base of the weapon, which moves together with the weapon and identifies the direction of the barrel of the weapon, at least a right limit switch, at least a left limit switch placed on the fixed portion of said base which identify the right and left limit angle.

6. The system according to claim 5, wherein the sensor assembly possibly also comprises an intermediate identifier of a whole traverse angle.

7. The system according to claim 6, wherein during the traverse of the weapon, the selector aligns with the limit switches or with the intermediate identifier, an identifiable signal is transmitted to the control unit.

8. The system according to claim 7, wherein the selector, the limit switches and the intermediate identifier comprise proximity sensors, or infrared sensors, or emitting and receiving LED arrays, or through inductive electromagnetic or variable reluctance devices or Hall effect devices.

9. The system according to claim 1, comprising on the fifth wheel transmission means of determination of angular rotation of the movable portion with respect to the fixed portion, in order to be able to rotate the fifth wheel with one or more predetermined angles in response to reaching of a right or left predetermined limit traverse angle.

10. The system according to claim 9, wherein data transmission between movable and fixed portions with respect to the roof of the vehicles occurs through use of wireless devices or use of LED emitters or receiving photo-diodes or slip rings or for angles limited with cables.

* * * * *